United States Patent [19]

Brackmann et al.

[11] Patent Number: 4,896,681

[45] Date of Patent: Jan. 30, 1990

[54] TOBACCO BLEND FORMATION

[75] Inventors: Warren A. Brackmann, Mississauga; Takeshi Nehyo, Willowdale; Michael H. Sheahan, Toronto; Stanislav M. Snaidr, Mississauga, all of Canada

[73] Assignees: Rothmans, Benson & Hedges Inc., North York, Canada; Rothmans International Services Limited, Bucks, United Kingdom

[21] Appl. No.: 230,885

[22] Filed: Aug. 11, 1988

[30] Foreign Application Priority Data

Aug. 11, 1987 [GB] United Kingdom ..... 8718949

[51] Int. Cl.[4] ..... A24C 5/18

[52] U.S. Cl. ..... 13/84.3; 131/84.1

[58] Field of Search ..... 131/84.3, 84.4, 84.1

[56] References Cited

U.S. PATENT DOCUMENTS

| | | |
|---|---|---|
| 1,721,117 | 3/1924 | Hopkins . |
| 2,423,554 | 4/1947 | Davidson . |
| 3,795,249 | 1/1974 | Cristiani . |
| 3,880,171 | 6/1975 | Naylor . |
| 4,009,722 | 3/1977 | Wahle et al. . |
| 4,516,585 | 4/1985 | Pinkham . |
| 4,605,013 | 2/1986 | Goldbach . |
| 4,616,662 | 1/1986 | Hartmann et al. . |
| 4,630,618 | 3/1986 | Chard . |
| 4,693,263 | 4/1987 | Wahle et al. . |

FOREIGN PATENT DOCUMENTS

| | | |
|---|---|---|
| 2015387 | 3/1971 | Fed. Rep. of Germany . |
| 2101865 | 2/1972 | Fed. Rep. of Germany . |
| 2134768 | 7/1983 | United Kingdom . |
| 2171887 | 2/1984 | United Kingdom . |
| 2171888 | 2/1984 | United Kingdom . |
| 2171889 | 2/1984 | United Kingdom . |
| 2172187 | 2/1984 | United Kingdom . |

*Primary Examiner*—V. Millin

*Attorney, Agent, or Firm*—Sim & McBurney

[57] ABSTRACT

A cigarette filler rod-forming method and apparatus therefor are described for production of a filler rod containing two different blends of tobacco, so as to provide to a cigarette formed from the filler rod more uniform smoking characteristics. Discrete bunches of tobacco of a first blend are formed by employing a vacuum wheel having a belt which forms chords of a circle, so that, after trimming, the bunches have a flat surface adjacent the belt and a curved outer surface. Spaces between the bunches are filled with tobacco of another blend at least to the maximum height of the bunches of the first blend of tobacco, by a variety of procedures.

41 Claims, 6 Drawing Sheets

51% Filler blend
49% Flavor blend

72% Filler blend
28% Flavor blend

72% Filler blend
28% Flavor blend

73% Filler blend
27% Flavor blend
FLAVOR BLEND FIRST

53% Flavor blend
47% Filler blend

84% Filler blend
16% Flavor blend

73% Filler blend
27% Flavor blend

79% Filler blend
21% Flavor blend

77% Filler blend
23% Flavor blend
FILLER BLEND FIRST
Clipped sidewalls

TOBACCO BLEND FORMATION

FIELD OF THE INVENTION

The present invention relates to the formation of tobacco blends in cigarette filler rod formation.

BACKGROUND OF THE INVENTION

It is well known that, during the smoking of a cigarette, the quantity of flavour components in the smoke tends to increase as the cigarette is smoked, so that the last puff usually contains approximately three times the amount of flavour components than the first puff.

Attempts have been made to provide cigarettes in which the tobacco blend in the filler rod is varied to achieve a more uniform taste to the tobacco smoke as it is smoked. Recently there was introduced to the market in the Federal Republic of Germany under the brand name "DOUBLE BLEND", a cigarette having a rod composed of two different blends. The lighting end of the cigarette contains a blend of strong aromatic tobaccos while the filter end of the cigarette consists of lighter, milder tobaccos, to provide a more even taste than a single one of the blends or a single blend make up of the two types of tobacco. It is claimed for this cigarette by the manufacturers that not only is a strong even tasting cigarette provided but this result is achieved with low tar and nicotine values of 8 mg and 0.8 respectively.

One of the major problems associated with such two-blend cigarettes is production of a continuous filler rod at the high speeds, typically up to about 4000 cigarettes per minute, required in modern production. Information currently available from trade literature (Tobacco Journal International, Jan. 1987) indicates that the individual blends are fed from separate feeders to a rod-forming conveyor belt as follows:

> "a pocket gear draws up the milder blend by suction from the first feeder and distributes it in small piles on the conveyor belt at equal intervals. The stronger blend is then drawn from below and placed in the gaps".

This type of rod-forming operation and apparatus to effect the same is described in published U.K. patent applications Nos. 2,134,768 (= U.S. Pat. No. 4,605,013), 2,171,887 (= U.S. Pat. No. 4,693,263), 2,171,888, 2,171,889 (= U.S. Pat. No. 4,693,262) and 2,172,187 (U.S. Pat. No. 4,693,263).

With the exception of U.K. patent publication No. 2,172,187, the stronger blend tobacco is showered onto the spaced-apart discrete lengths of the milder blend tobacco on the conveyor surface and the stronger blend tobacco which overlies the discrete lengths of milder blend tobacco. In the case of U.K. patent publication No. 2,172,187, discrete lengths of the stronger blend tobacco are formed in the same way as the discrete lengths of milder blend tobacco and positioned between the discrete lengths of the milder blend tobacco on the conveyor surface. The rod forming operation described in this prior art is complex in operation and difficult to control to obtain a consistent product.

Other attempts to form multiple blend cigarette rods is described in the art. U.S. Pat. No. 3,880,171 (= W.G.O.S. 2,259,814) describes a procedure in which tobacco of a first blend is showered onto a rod-forming conveyor to form a generally uniform filler rod, which then is carried past trimming knives which cut the rod into discrete tobacco lengths of a double wedge profile. These discrete lengths of tobacco then are showered upon by another blend of tobacco to fill the gaps between and to overlie the discrete lengths. Excess tobacco then is trimmed to provide the final rod. This procedure differs from that described in the above-noted published U.K. patent application in that the discrete tobacco lengths are formed in two steps and have a double-wedge profile.

U.S. Pat. No. 4,009,722 (= W.G.O.S. 2,445,856) again is similar to the procedure of the published U.K. patent application, except that the gaps between the discrete lengths of the first blend are filled in from a downwardly-flowing shower and the discrete lengths are formed from a downwardly-flowing shower on a pocket vacuum wheel.

U.S. Pat. No. 4,630,618 is similar to U.S. Pat. No. 3,880,171 in that the discrete lengths of tobacco which are subsequently showered upon are formed from a continuous filler rod, in this instance by selective blowing tobacco from the filler rod.

SUMMARY OF THE INVENTION

In the present invention, the same principle as is employed in the prior art is employed, namely formation of discrete lengths of one blend of tobacco material, and filling in the gaps between the discrete lengths with a second blend of tobacco material. However, the manner of effecting such operation is quite different from the various procedures disclosed in the prior art, is simple to effect and enables a considerable flexibility with respect to the relative proportions of the blends of different tobaccos in the filler rod.

Accordingly, in one aspect of the present invention, there is provided a method of forming a tobacco filler rod containing two blends of tobacco material, which comprises a plurality of steps. A vacuum wheel is rotated about a horizontal axis. The vacuum wheel has a tobacco-conveying surface defined by a plurality of chords of a circle having its centre coinciding with the axis and arranged about a periphery of the vacuum wheel.

A plurality of bunches of a first blend of tobacco particles is formed on the tobacco-conveying surface of the vacuum wheel. Each of the bunches has a flat surface adjacent the tobacco-conveying surface and a curved surface spaced from the tobacco-conveying surface which curves outwardly from both its ends to a location of maximum thickness. The bunches define a space therebetween extending from the tobacco conveying surface outwardly to a thickness corresponding to the maximum thickness.

A second blend of tobacco particles different in smoking characteristics from the first blend then is provided filling the space between each of the adjacent bunches to the thickness corresponding to the maximum thickness. In this way, a filler rod is provided of uniform cross-sectional dimension corresponding in thickness at least to the maximum thickness of the tobacco bunches.

The present invention also includes apparatus for carrying out the method of the invention, including vacuum wheel means, means for forming the bunches and means for filling the space between the bunches.

GENERAL DESCRIPTION OF INVENTION

Figure 1:
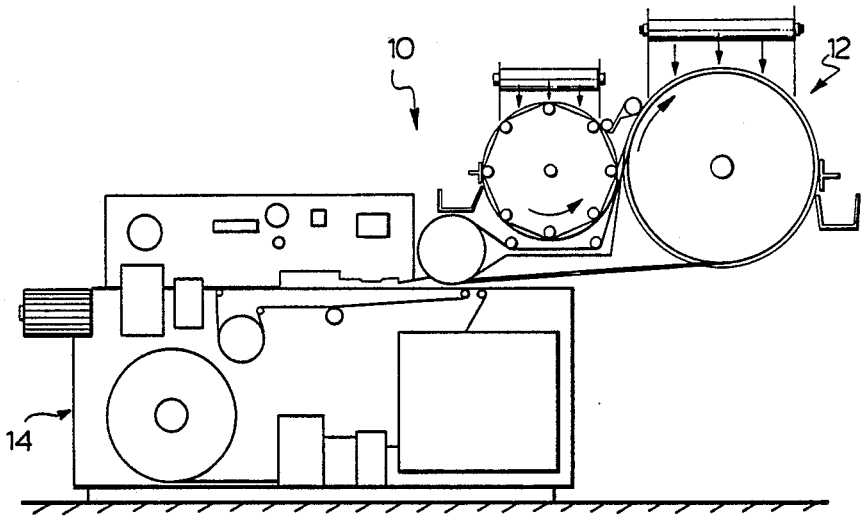
FIG. 1 is an overall schematic elevational view of one embodiment of a cigarette rod-forming machine incorporating the novel filler rod-forming operation of the invention.

In the present invention, a plurality of bunches of a first blend of tobacco particles is formed on a tobacco conveying surface. Generally, the filler rod is formed of two blends of tobacco particles which differ significantly in one or more characteristics, such as flavour, so as to produce in the final cigarette containing the two-blend filler rod a more even smoke taste during smoking. In the present invention, the stronger flavoured tobacco ("flavour blend") usually is employed to form the bunches while the lesser flavoured tobacco ("filler blend") is subsequently incorporated into the filler rod, although the reverse may be employed.

The bunches of tobacco have a flat lower surface and a curved upper surface which curves from both ends to a maximum thickness. This shape is achieved by virtue of the manner of formation on the rod-conveying surface.

A vacuum wheel is provided which has the tobacco-conveying surface defined by a plurality of chords of a circle having its centre coinciding with the horizontal axis about which the vacuum wheel rotates, the chords being arranged about the periphery of the vacuum wheel, usually between solid circular side walls. The tobacco-conveying surface is arranged in the plane of a circle and laterally-thin stream of vertically-moving, usually downwardly particles of first blend and rotates transverse thereto.

The tobacco particles in the wide stream are captured on the length of the tobacco-conveying surface corresponding to the width of said wide stream, either directly from the vertically-moving stream or by first forming substreams from the vertically-moving shower and depositing the substreams sequentially on the tobacco-conveying surface.

Resulting from this rod-forming procedure is a filler rod of substantially uniform thickness of the first blend of tobacco particles. While the rod is still maintained by vacuum on the surface of the wheel, tobacco from the first blend is trimmed from the filler rod to a dimension corresponding generally to the radius of the side walls which also corresponds to one end of each of the chords. As a result of this trimming, there is provided on the tobacco conveying surface a plurality of bunches of the first blend of tobacco particles each of which has a flat lower surface corresponding to the chord of the circle and a curved upward surface which curves upwardly from both its ends to a location of maximum thickness from the tobacco conveying surface. With the trimmer location coinciding with the maximum diameter of the side walls, each of the bunches curves continuously from each end to an apex corresponding to the maximum distance from the conveying surface to the diameter of the side walls and coinciding substantially with the midpoint of the length of each chord of tobacco-conveying surface.

The tobacco bunches are spaced apart on the tobacco-conveying surface and define spaces therebetween extending from the tobacco-conveying surface to a thickness corresponding to the maximum thickness of the bunches. In the preferred procedure, the spaces extend longitudinally between the apices of the bunches.

Once the bunches have been formed in this way, a second blend of tobacco particles then is provided to fill the space between each of the adjacent bunches to the thickness which corresponds to the maximum thickness of the bunches. The second blend of tobacco particles may extend beyond the maximum thickness of the bunches and, in this embodiment, also overlies the bunches so as to provide a filler rod of substantially uniform cross-sectional dimension.

The filling in of the spaces by the second blend of tobacco particles may be effected in any convenient manner. In one embodiment, the bunches of first blend tobacco are conveyed on a tobacco-carrying surface across the width of a vertically-moving wide and laterally-thin stream of a second blend of tobacco particles, which are captured on the length of the tobacco conveying surface corresponding to the width of the wide stream of a second blend of tobacco particles, either directly from the vertically-moving stream or by first forming substreams from the vertically-moving shower and depositing the substreams sequentially on the tobacco-conveying surface and the bunches of tobacco thereon.

Resulting from this second rod-forming procedure is a filler rod which has a layer of a second blend of tobacco particles of substantially uniform thickness filling the spaces between the apices of the bunches and overlaying the bunches of first blend tobacco particles.

The tobacco-conveying surface employed in this second rod-forming operation preferably is the same tobacco conveying surface on which the bunches of first blend tobacco particles were formed and preferably is supported on the periphery of and between the side walls of a vacuum wheel rotating about a horizontal axis and located in the plane of the shower of second blend tobacco particles.

Excess of the second blend of tobacco particles then is removed by trimming while the filler rod is conveyed by the tobacco-conveying surface on the periphery of the vacuum wheel. Usually, the filler rod is trimmed to the height of the side walls above the tobacco-conveying surface which generally corresponds to the maximum thickness of the bunches, so that the resulting uniform thickness filler rod comprises the bunches of first blend tobacco particles and, in effect, bunches of the second blend tobacco particles filling the space between the apices of the bunches of first blend tobacco particles. If desired, the depth of the side walls or the location of the trimmer may be adjusted to provide a uniform-thickness filler rod having second blend tobacco particles overlying the first blend bunches.

Although the procedures just described are technically feasible for forming the two-blend filler rod, they do suffer from the drawback that a considerable amount of the second blend of tobacco particles must be trimmed from the filler rod and recycled. It is known that trimming causes degradation of the filling power of tobacco and this effect is undesirable. This necessity for such trimming arises from capturing tobacco from the whole width of the second tobacco blend. In addition to the problem of trimming and recycle, the overfilling of the filler rod by the second blend material necessary to ensure a complete filling of the space between the apices of adjacent bunches provides a greater density of tobacco where there is a thicker portion of the layer in the untrimmed filler rod than in the thinner portions of the layer in the untrimmed filler rod, leading to a non-uniform product.

In accordance with a preferred embodiment of the present invention, these difficulties are overcome by forming bunches of the second blend of tobacco particles in the same manner as described above, for the bunches of the first such blend and then transferring the tobacco in the bunches of the second blend of tobacco particles into and to fill the spaces between the bunches of the first blend of tobacco material. In this way, only tobacco in the second bunches is used to fill the spaces between the first bunches and only a minimum degree of trimming, if at all, is required.

The transfer of the tobacco in the bunches of the second blend of tobacco particles may be transferred into and to fill the spaces between the first blend bunches by vertically aligning the second blend bunches with the spaces between the first blend bunches so that the first blend bunches similarly align with the spaces between the second blend bunches and then converging the tobacco-conveying surface so that the second blend bunches merge with the spaces between the first blend bunches and the first blend bunches merge with the spaces between the second blend bunches, so as to form a filler rod of substantially uniform cross section on the tobacco-conveying surface on which the first blend bunches were formed.

The transfer of tobacco in the bunches of the second blend of tobacco particles also and is more conveniently transferred into and fill the spaces between the first blend bunches again by vertically aligning the second blend bunches with the spaces between the first blend bunches with the first blend bunches similarly aligned with the spaces between the second blend bunches and then removing the tobacco particles in the second blend bunches from the tobacco-receiving surface on which they were formed and transporting the removed tobacco particles into the spaces between the first blend bunches.

The removal of the tobacco particles in the second blend bunches from their tobacco-receiving surface is most effectively done by conveying the second blends under the influence of vacuum to a location where the second blend bunches close to the tobacco-conveying surface for the first bunches and then releasing the vacuum, so that the particles are drawn under the influence of vacuum acting on the first bunches off the tobacco-conveying surface for the first bunches and into the spaces between the first bunches. This action may be assisted by an air jet.

The latter operation is most effectively carried out immediately prior to the garniture of the making machine, with the first bending bunches being transported under the influence of vacuum on the underside of the tobacco-conveying surface and then converging the second tobacco-conveying surface with the second bunches transported on the upper surface thereof under the influence of vacuum to a location where the vacuum effect from the upper tobacco conveying surface is sufficient to affect the second bunches.

After the filler rod comprising the two tobacco blends has been formed in accordance with the present invention by the procedures described above, the filler rod is forwarded to the garniture of a standard cigarette rod former, wherein the filler rod is wrapped in paper to form a continuous cigarette rod from which individual cigarettes are cut and then tipped.

The rod-forming procedure which is carried out in the present invention contrasts markedly from the prior art operations described in the references discussed above. In no prior art procedure are bunches of tobacco particles shaped as described herein formed on a tobacco-conveying surface shaped as defined with subsequent rod formation.

DESCRIPTION OF THE PREFERRED EMBODIMENTS

Referring now to the drawings and first to FIG. 1, there is illustrated the overall schematic of a cigarette making machine 10 comprising a filler rod forming operation 12 in which a continuous tobacco filler rod is formed from two separate blends of tobacco which differ one from another by a smoking characteristic and a cigarette rod forming operation 14, in which the filler rod is wrapped in paper to form a continuous cigarette rod, separated into individual cigarette lengths and tipped by conventional means.

The cigarette rod forming operation 14 constitutes the present invention. In FIGS. 2 to 6 are illustrated five separate embodiments of apparatus for carrying out the novel filler rod forming operation. Certain common principles of operation are embodied therein, as will be apparent from the description below, and any apparatus which effects such principles is included within the scope of the invention.

Figure 3:
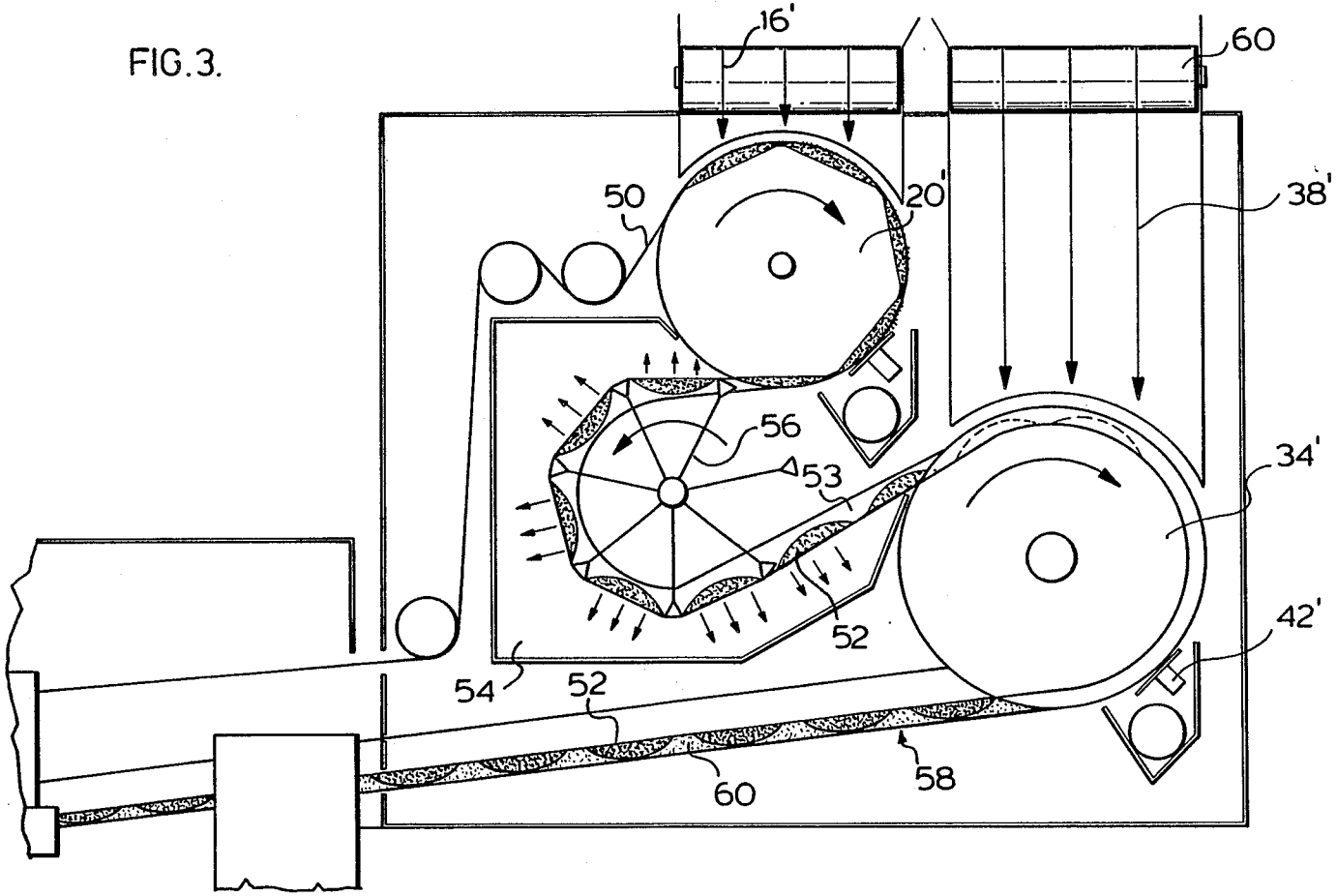
FIG. 3 is a schematic elevational view of another embodiment of apparatus for carrying out the novel filler rod-forming operation of the invention.

Tobacco, in the form of two separate blends, is processed to provide a tobacco filler rod for passage to a rod-forming operation. The blends may comprise a highly-flavoured blend and lesser flavoured blend to provide for a more uniform smoking taste in the cigarette ultimately produced from the filler rod than is achievable with a single blend. The separate blends may be provided from separate cigarette hoppers of any convenient construction, preferably from the so-called "Flow-Through" hopper described in our published European patent application No. 86303720.6 and in the corresponding U.S. Pat. No. 4,754,765 issued July 5, 1988, the disclosure of which is incorporated herein by reference. In the embodiment of FIG. 3, described below, a single flow-through hopper may be used.

Figure 2:
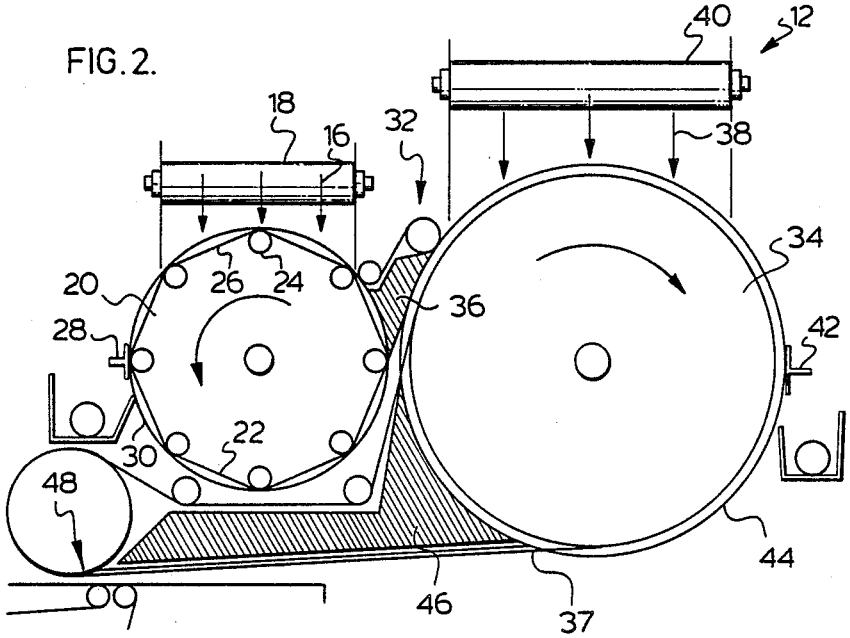
FIG. 2 is a close-up schematic elevational view of the one embodiment of apparatus of FIG. 1.

Referring specifically to FIG. 2, tobacco of a first blend is fed as a downwardly-flowing wide laterally-thin shower 16 from the end of a conveyor 18 towards a first vacuum wheel 20. The use of vacuum wheels to form tobacco filler rods is described generally in U.S. Pat. No. 3,980,088, assigned to the assignee hereof, the disclosure of which is incorporated herein by reference.

The vacuum wheel 20 has a foraminous belt 22 which is mounted on circumferentially-spaced supports 24 on the wheel 20 to provide a plurality of straight sections or chords of a circle 26 between adjacent supports 24. A trimmer 28 is provided adjacent the periphery of the wheel 20 to remove any excess of tobacco from the height of tobacco desired on the belt 22.

As tobacco falls from the shower 16 onto the belt 22, tobacco is captured by the vacuum applied through the belt 22 by the wheel 20. As the wheel rotates, tobacco above the height of the perimeter walls 30 of the wheel is removed by trimmer 28 to provide, in effect, a series of arcuate tobacco bunches supported on the belt 22 between adjacent pairs of the supports 24 and confined between the side walls 30.

The tobacco bunches are transported by the belt 22 under the influence of vacuum to a transfer location 32 whereat the tobacco portions are transferred to a second vacuum wheel 34. At the transfer location 32, a vacuum shoe 36 is provided adjacent a straight section of the belt 22 extending generally tangentially to the second vacuum wheel 34. The tobacco bunches on the belt 22 come under the influence of vacuum applied through foraminous belt 37 on the wheel 34 and are transferred thereto upon release of the vacuum applied through the belt 22.

Tobacco is fed as a shower 38 from the end of a conveyor 40 towards the second vacuum wheel 34. The tobacco so fed generally has different smoking characteristics from that contained in the shower 16 to provide a two-blend cigarette. The tobacco in the shower 38 is captured directly on the belt 37 from the shower 38. Tobacco from the shower 38 forms a substantially uniform cross-sectioned layer which fills the spaces on the belt 37 between the tobacco bunches transferred from the wheel 20 to the wheel 34 and also overlies them. It is necessary to supply more tobacco to the shower 38 than is necessary simply to fill the spaces between adjacent bunches in view of the so-called shadow effect whereby clumps of tobacco can prevent other tobacco from filling behind the clump. Overlying and excess tobacco is trimmed from the filler rod by a trimmer 42 provided adjacent the periphery 44 of the vacuum wheel 34.

The resulting tobacco filler rod having a substantially uniform cross-sectional thickness and, in effect, comprising alternate overlapping bunches of first and second types of tobacco from the two different tobacco showers 16 and 38, is transported by the belt 37 from the vacuum wheel 34 under the influence of vacuum applied by a vacuum shoe 46 to the garniture 48 of the cigarette rod forming portion 14. From the cigarette rod-forming portion, there results a cigarette rod having longitudinally adjacent and overlapping portions of different types of tobacco. Different arrangements of the tobacco in cigarettes formed from the cigarette rod are possible, depending on the location of the trimmer 28 and 42 with respect to the periphery of the vacuum wheel 20 and 34.

In the embodiment of FIG. 2, the two vacuum wheels 20 and 34 use separate foraminous belts 22 and 37 to transport tobacco. In the embodiment of FIG. 3, a single foraminous belt 50 is used in which is arranged to travel on both vacuum wheels 20' and 34' and also into and through the cigarette rod forming section 14. Transfer of the tobacco bunches 52 formed on the vacuum wheel 20' from the shower 16' from wheel 20' to wheel 34' is effected with the assistance of a vacuum shroud 54 which maintains the tobacco bunches 52 with spaces 53 therebetween in contact with the belt 50 while the belt 50 is supported by a spoked wheel 56 at contact points. On the vacuum wheel 34', tobacco from the shower 38' fills and overfills the spaces 53 and overlies the bunches 52, as described above for the embodiment of FIGS. 1 and 2, so that, after trimming excess quantities of the second tobacco stream using trimmer 42', there results a filler rod 58 having alternate bunches 52 of first tobacco material and 60 of a second tobacco material adjacent to and overlapping one another.

Figure 4:
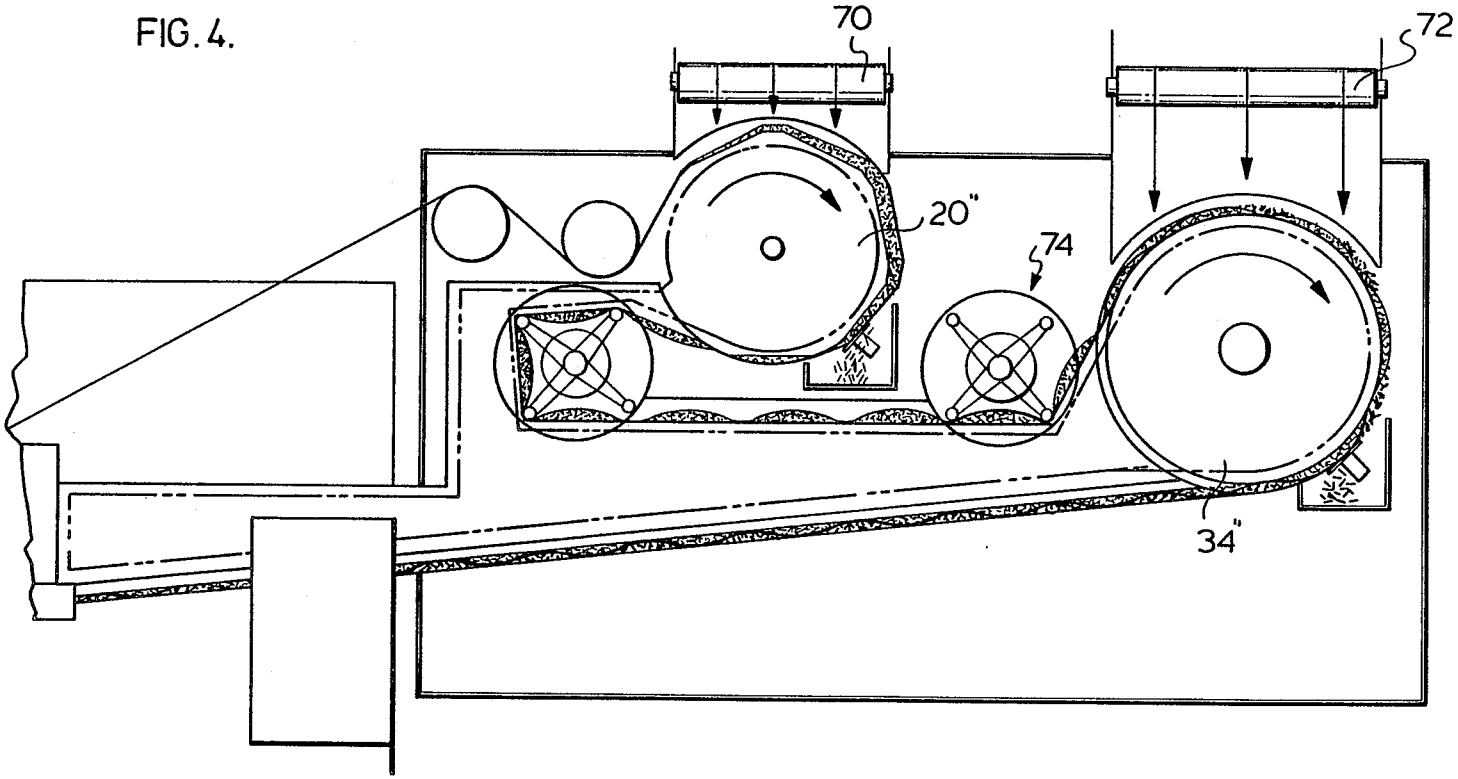
FIG. 4 is a schematic elevational view of a further embodiment of apparatus for carrying out the novel filler rod-forming operation of the invention.

In the embodiment of FIG. 3, tobacco is delivered to the shower 16' and 38' from the end of a single conveyor 60. The embodiment of FIG. 4 is similar to FIG. 3, except that two separate conveyors 70 and 72 are used to feed the different tobacco blends to the vacuum wheels 20'' and 34''. To accommodate the changed geometry resulting from spacing apart of the two conveyors, a second vacuum shrouded transfer wheel 74 having spoke arms 76 is employed.

In the various embodiments of FIGS. 1 to 4, the tobacco bunches and the subsequent filler rod formation are effected directly from falling showers of tobacco particles. As stated earlier, it is necessary to considerably over-supply tobacco to the formation of filler rods, in order to compensate for the shadow effect. The embodiment of FIG. 5 is designed to decrease the over-supply requirement by decreasing significantly the incidence of shadow formation.

This effect is achieved by employing the principle described in U.S. Pat. No. 3,980,088, namely that by initially forming substreams of tobacco from the tobacco shower and then laying the substreams sequentially on the belt, significantly better control over rod formation is achieved, thereby substantially improving the uniformity of the rod. Since the uniformity of the rod is improved, then the degree of overfill required to ensure uniformity after trimming is decreased.

Figure 5:
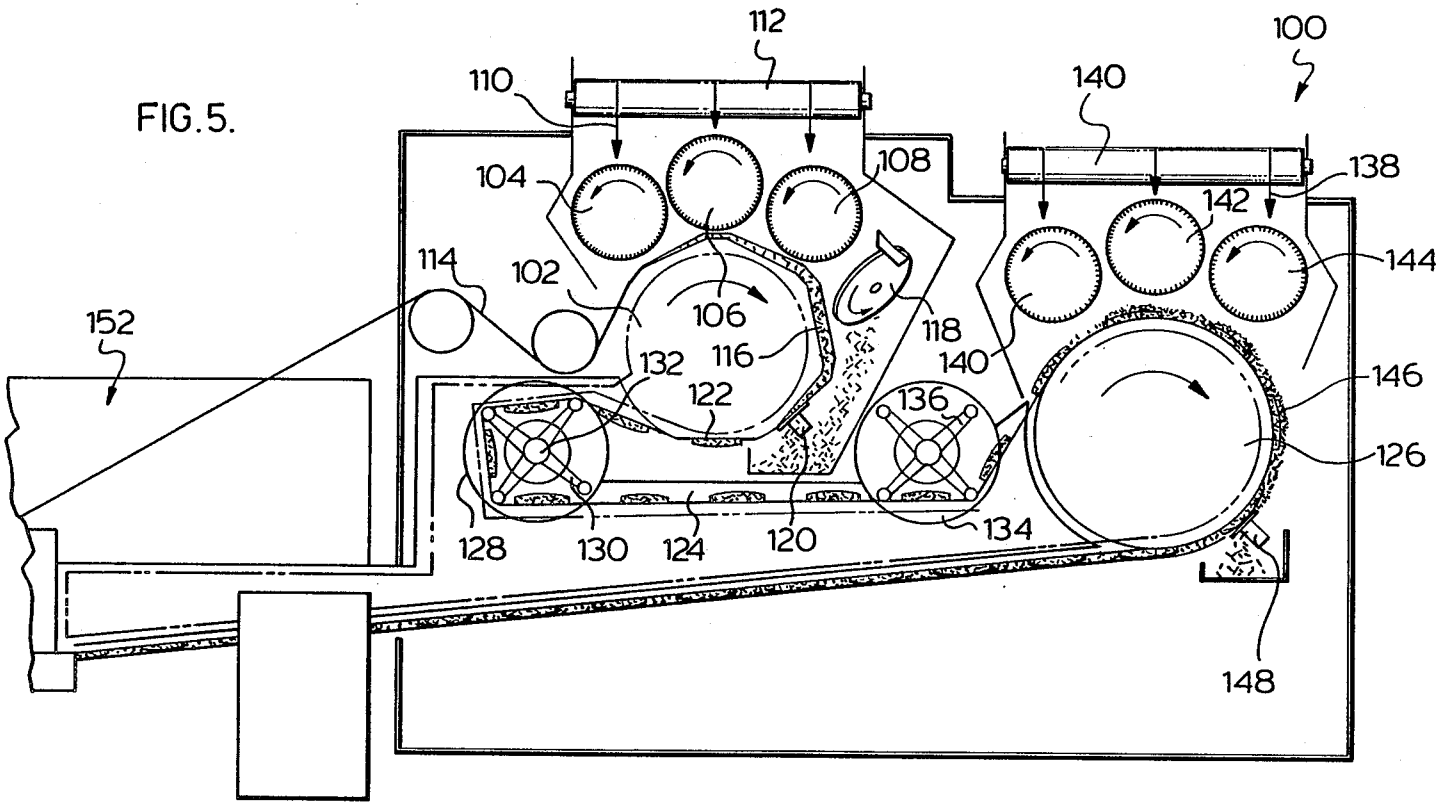
FIG. 5 is a schematic elevational view of a yet further embodiment of apparatus for carrying out the novel filler rod-forming operation of the invention.

As seen in FIG. 5, a cigarette filler rod-forming apparatus 100 comprises a first vacuum wheel 102 having a structure the same as vacuum wheel 20' and three vacuum wheels 104, 106, 108 arranged equally spaced around the periphery of the vacuum wheel 102 to receive tobacco of a first blend of tobacco particles from a falling shower 110 of the same falling from the end of a conveyor 112. Capture of tobacco particles on the rotating surface of the vacuum wheels 104, 106, 108 forms substreams of tobacco which are transferred to the tobacco in conveying surface 114 by cut-off of the application of vacuum through the surface of the vacuum wheels 104, 106, 108 adjacent the surface 114 to form a filler rod 116 on the belt 114.

If desired, a sculpting knife 118 may be provided to cut away portions of the filler rod 116 to provide for blunt ends to tobacco bunches. Shaping of the ends of the tobacco bunches provided after trimming also may be achieved by blocking off the application of vacuum for a desired length of each of the chords of the belt 114, so that no tobacco is captured in that region.

A trimmer 120 is provided which trims from the filler rod 116 tobacco of the first blend extending above the periphery of the vacuum wheel 102, thereby providing discrete bunches 122 of first blend tobacco spaced apart from one another by spaces 124.

The individual bunches 122 are conveyed under the influence of vacuum from leaving the first vacuum wheel 116 to a second vacuum wheel 126, using a first external vacuum shroud 128 with the belt 114 being supported by radial arms 130 extending outwardly from an axle 132 to reverse the direction of movement of the belt 114 and a second external vacuum shroud 134 with the belt 114 being supported by radial arms 136 to change from horizontal movement to angular movement to tangentially engage the vacuum wheel 126.

A falling shower 138 of a second blend of tobacco particles is permitted to fall from the end of the conveyor 140 towards the vacuum wheel 126, which has the belt 114 recessed between side walls. Three small vacuum wheels 140, 142, 144 are provided equally circumferentially spaced about the periphery of the vacuum wheel 126 to form substreams of tobacco on the surface thereof from the falling shower 138, in the same way as small vacuum wheels 104, 106, 108. The substreams formed on the surfaces of the small vacuum wheels 140, 142, 144 are transferred to the conveying surface 114 by cutting off the application of vacuum through the surface of the wheels adjacent the wheel 126.

The substreams of tobacco form a filler rod 146 of the second tobacco in the spaces 124 and overlying the bunches 122. In view of the greater control over rod formation achieved using the substreams, the need to use excess tobacco is substantially decreased. This composite rod is transported by the conveyor surface 114 past a trimmer 148, which removes the tobacco overlying the bunches 122 and provides a trimmed filler rod 150 which is forwarded to a cigarette rod-forming operation 152. The filler rod comprises bunches 122 of the first blend of tobacco and alternating second bunches of the second blend of tobacco filling the spaces 124 and overlapping the bunches 122.

Figure 6:
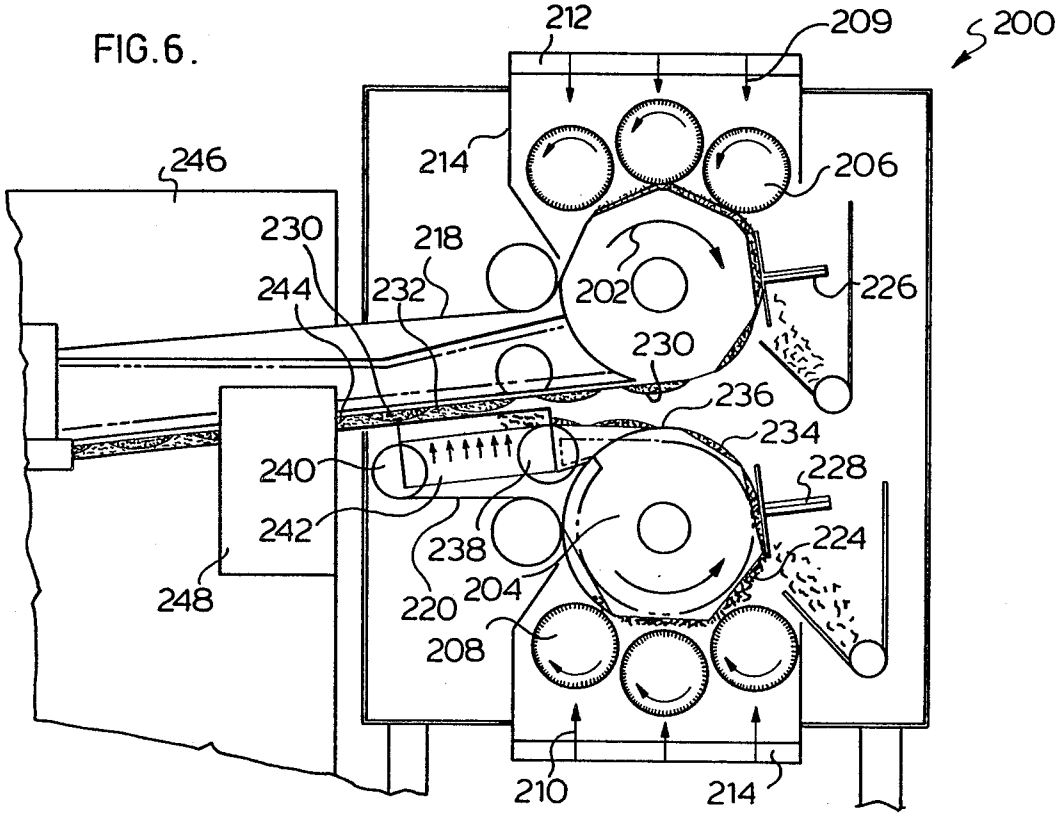
FIG. 6 is a schematic elevational view of the current best mode of apparatus known to the applicants for carrying out the novel filler rod-forming operation of the invention.
Figures 7A, 7B, 7C, 7D, 7E, 7F, 7G, 7H, 7I:
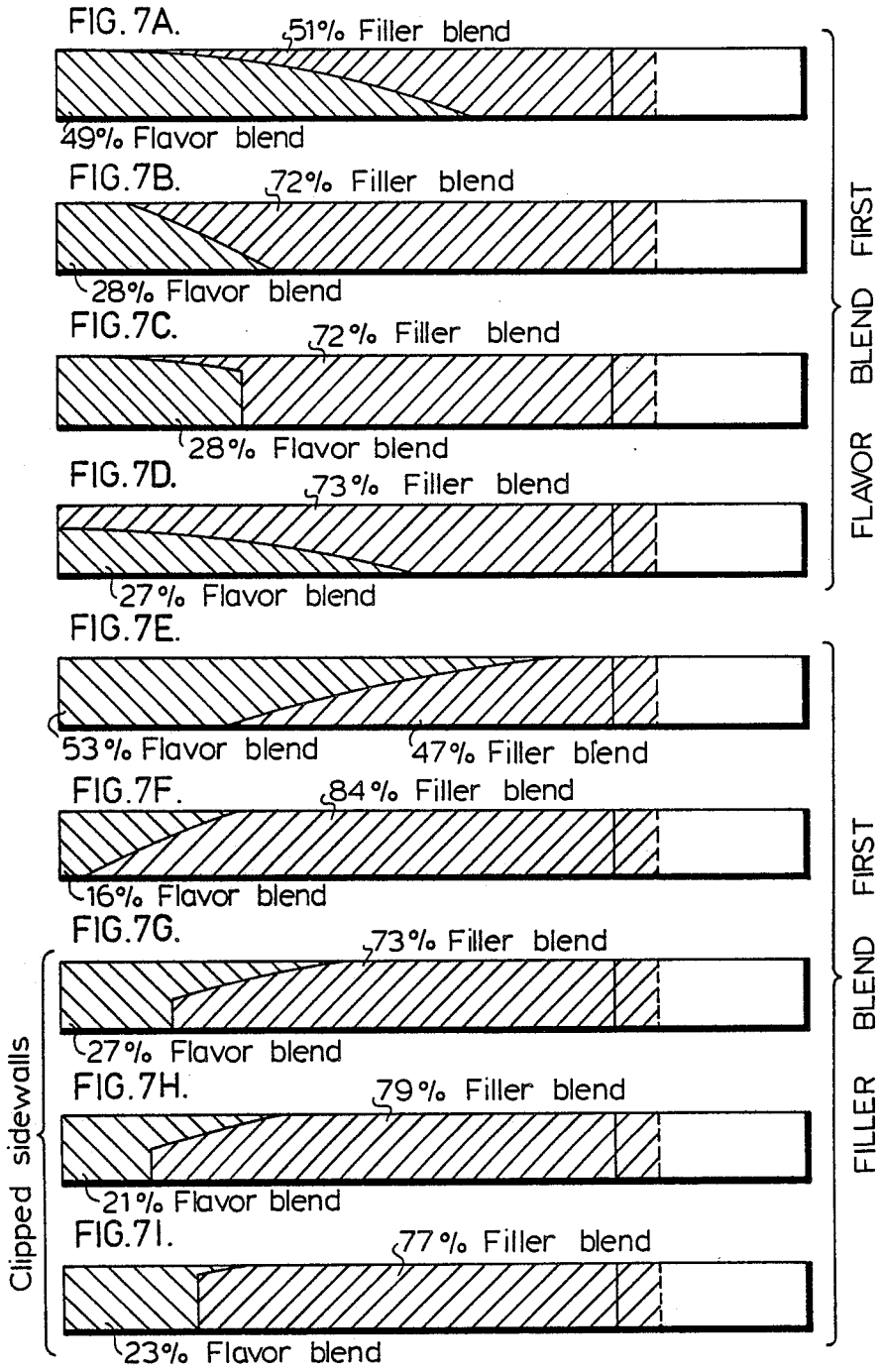
FIGS. 7A to 7I show a variety of examples of two-blend filler rods which are attainable using the present invention.

Referring now to FIG. 6, there is shown therein the current best mode known to the applicants for putting the invention into effect. In each of the embodiments of FIGS. 1 to 5, the bunches of the first blend of tobacco have a coherent filler rod of a second blend of tobacco formed thereover, which then requires a considerable amount of the second blend of tobacco to be trimmed and recycled. The filler rod making machine 200 is designed to overcome this problem by providing tobacco bunches from the two different tobacco blends and then assembling the bunches together.

As seen therein, first and second vacuum wheels 202 and 204 are identically structured and have the structure of the vacuum wheel 20' each with three small vacuum wheels 206, 208 adjacent the periphery thereof arranged across the widths of showers 209, 210 of two separate blends of tobacco. In the case of shower 209, the tobacco falls from the end of a conveyor 212 confined by chute 213 while in the case of shower 210, the tobacco is drawn upwardly from a conveyor 214 confined by chute 216.

On each of the sets of small vacuum wheels 206 and 208, substreams of tobacco are formed from the respective tobacco showers 209 and 210 which are deposited on respective tobacco-conveying surfaces 218, 220 on the periphery of the vacuum wheels 202, 204, in the manner described above with respect to FIG. 5, to form tobacco rods 222 and 224. Trimmers 226, 228 are positioned adjacent the periphery of each of the vacuum wheels 202, 204 to remove tobacco projecting beyond the periphery and to form a plurality of bunches 230 of the first blend of tobacco on the surface of the tobacco-conveying belt 218 spaced apart by spaces 232 and a plurality of bunches 234 of the second blend of tobacco on the surface of the tobacco-conveying belt 220 spaced apart by spaces 236.

The tobacco bunches 230 and 234 have a flat surface adjacent the respective belts 218, 220 and a curved outer surface, as seen in the drawing. These tobacco bunches 230 and 234 are transported by vacuum on the lower surface of belt 218 and on the upper surface of belt 220 off the respective wheels 202, 204, in a convergent relation with the bunches 234 located opposite to the spaces 232 and the bunches 230 located opposite to the spaces 236. As the belt 220 passes over a guide roll 238, the vacuum is cut off and the belt 220 then runs parallel to the belt 218 to a turn-around guide roll 240. An air chamber 242 is provided adjacent the conveyor belt 220 for this run to guide air, drawn by the vacuum applied to the upper belt 218, through the lower belt 220 and thereby remove the tobacco particles in the bunches 234 on the belt 220 and reposition those particles in the spaces 232 between the between the bunches 230 to form a filler rod 244 containing the two blends of tobacco with bunches 230 of the first blend of tobacco adjoining and overlapping with bunches of the second blend of tobacco formed by reassembly of the bunches 234 on the belt 218.

The transfer of the tobacco particles of the bunches 234 from the belt 220 onto and to fill the spaces 230 on the belt 218 may be effected in any other convenient manner, for example, by having roll 238 the turn-around roll and applying a jet of air to the tobacco particles of the bunches 234 as they reach the end of the conveyor belt, or by employing a picker roll adjacent the end of the conveyor belt to throw the tobacco particles of the bunches 234 toward the spaces 232 on the belt 218.

Operation in the manner described with respect to FIG. 6 overcomes the density problem referred to above. Some overfill, typically about 20%, again is required to ensure that the spaces 232 are fully filled with tobacco particles of the second blend to the depth of the bunches 230 of the first blend, but this is significantly less than arises when the whole width of the shower of the second blend is used to fill-in the spaces between the bunches of the first blend tobacco particles.

The filler rod 244 then is forwarded, transported by belt 218, to a standard cigarette rod-forming operation 246 which includes an initial trimming 248 to remove the excess of the tobacco of the second blend from the rod before wrapping in paper to form an elongate continuous cigarette rod, which then is cut to discrete lengths and tipped.

FIGS. 7A to 7I illustrates several forms of cigarette which can be formed using the apparatus described above with respect to FIGS. 1 to 6, depending on the mode of trimming and formation, and whether or not the more highly flavoured tobacco is fed as the first blend or the second blend. In these Figures, the caption "flavour blend first" means that the higher flavoured tobacco is fed to the first vacuum wheel and the caption "filler blend first" means that the lesser flavour tobacco is fed to the shaped vacuum wheel.

SUMMARY OF DISCLOSURE

In summary of this disclosure, the present invention provides a novel method of forming a multiblend filler rod by first forming discrete bunches of one blend of tobacco and subsequently filling in spaces between the discrete bunches with another blend of tobacco, using vacuum wheels and foraminous rod-forming belts.

Modifications are possible within the scope of this invention.

What we claim is:

1. A method of forming a tobacco filler rod, which comprises:

rotating about a horizontal axis a vacuum wheel having a tobacco-conveying surface defined by a plurality of rectilinear chords of a circle having its centre coinciding with said axis and arranged about a periphery of said vacuum wheel, forming on said tobacco-conveying surface a plurality of bunches of a first blend of tobacco particles having a flat surface adjacent said tobacco-conveying surface and a curved surface spaced from said tobacco-conveying surface and which curves outwardly from both its ends to a location of maximum thickness and defining a space between the bunches from said tobacco conveying surface outwardly to a thickness corresponding to said maximum thickness, and providing a second blend of tobacco particles different in smoking characteristics from the first blend filling the space between each of the adjacent bunches to said thickness corresponding to said maximum thickness of said bunches.

2. The method of claim 1 wherein said first blend is formed of tobacco particles of higher flavour than those in said second blend.

3. The method of claim 1 wherein said first blend is formed of tobacco particles of lesser flavour than those in said second blend.

4. The method of claim 1, wherein said plurality of bunches of a first blend of tobacco particles is formed by:

forming a vertically-moving wide and laterally-thin shower of said first blend of tobacco particles, positioning said vacuum wheel substantially in the plane of said shower of a first blend of tobacco particles with said tobacco-conveying surface moving transverse to the direction of movement of said shower, forming a filler rod of substantially uniform cross sectional dimension on said tobacco-conveying surface as said tobacco-conveying surface moves across the width of said shower, and trimming tobacco in said filler rod which projects beyond a predetermined distance from said axis.

5. The method of claim 4 wherein said shower is downwardly-moving.

6. The method of claim 4 wherein said filler rod is formed by capturing particles in said shower directly onto said tobacco-conveying surface in the width of said shower.

7. The method of claim 4 wherein said filler rod is formed by capturing particles in said shower on a plurality of small vacuum wheels arranged across the width of said shower so as to form a plurality of substreams of said first blend of tobacco particles one on the outer surface of each said small vacuum wheels, and laying said substreams one on another on said tobacco-conveying surface to provide said filler rod.

8. The method of claim 4 wherein said trimming is effected by a trimmer located adjacent the periphery of circular side walls of said vacuum wheel which coincides with the ends of the rectilinear chords of a circle defining said tobacco-conveying surface, so that each of said bunches comprises a flat inner surface coinciding with the rectilinear chord of the circle subtended by the tobacco conveying surface and a continuously-curved outer surface extending from the ends thereof to an apex at substantially the midpoint of the length of the chord.

9. The method of claim 4, wherein said second blend of tobacco particles is provided filling the space is effected by:

forming a vertically-moving wide and laterally-thin shower of said second blend of tobacco particles, moving a tobacco-conveying surface having said bunches thereon transverse to the direction of said shower of a second blend of tobacco particles, forming a second filler rod on said tobacco conveying surface comprising a substantially uniform cross section of said second blend of tobacco particles filling said spaces and overlying said bunches of first blend of tobacco particles, and trimming tobacco in said second filler rod which projects beyond a predetermined distance from said tobacco-conveying surface.

10. The method of claim 9 wherein said shower of second blend of tobacco particles is downwardly-moving.

11. The method of claim 9 wherein said filler rod is formed by capturing particles in said shower of said second blend of tobacco particles directly onto said tobacco-conveying surface in the width of said shower.

12. The method of claim 9 wherein said filler rod is formed by capturing particles in said shower on a plurality of small vacuum wheels arranged across the width of said shower of said second blend of tobacco particles so as to form a plurality of substreams of said first blend of tobacco particles one on the outer surface of each of said small vacuum wheels, and laying said substreams one on another on said tobacco-conveying surface to fill the space and overlie said bunches of first blend tobacco particles and thereby forming said filler rod.

13. The method of claim 9 wherein said tobacco-conveying surface is the same as that on which said bunches of first blend tobacco particles were formed, and is provided located between side walls at the periphery of a vacuum wheel rotating about a vertical axis and located in the plane of the second blend tobacco particles.

14. The method of claim 13, wherein said filler rod is trimmed to the height of the maximum thickness of the bunches of second blend tobacco particles, whereby the resulting uniform thickness filler rod comprises the bunches of first blend tobacco particles and bunches of second blend tobacco particles filling said spaces between said bunches of first blend tobacco particles.

15. The method of claim 1, wherein said second blend of tobacco particles is provided filling the spaces is effected by:

rotating about a horizontal axis a second vacuum wheel having a second tobacco-conveying surface defined by a plurality of rectilinear chords of a circle having its centre coinciding with said axis and arranged about a periphery of said second vacuum wheel, forming on said second tobacco-conveying surface a plurality of second bunches of a second blend of tobacco particles having a flat surface adjacent said second tobacco-conveying surface and a curved surface spaced from the tobacco-conveying surface and which curves outwardly from both its ends to a location of maximum thickness and defines a space between the second bunches extending from said second tobacco-conveying surface outwardly to a thickness corresponding to said maximum thickness of said second bunches, and transferring tobacco particles in said second bunches of said second blend of tobacco to fill the space between each of the adjacent bunches of the first blend of tobacco particles to said thickness corresponding to said maximum thickness of said bunches of the first blend of tobacco particles.

16. The method of claim 15, wherein said second plurality of bunches of a second blend of tobacco particles is formed by:

forming a vertically-moving wide and laterally-thin shower of said second blend of tobacco particles, positioning said second vacuum wheel substantially in the plane of said shower of said second blend of tobacco particles with said second tobacco-conveying surface moving transverse to the direction of movement of said shower of said second blend of tobacco particles, forming a second filler rod of substantially uniform cross-sectional dimension on said second tobacco conveying surface as said second tobacco-conveying surface moves across the width of said shower of second blend of tobacco particles, and trimming tobacco in said second filler rod which projects a predetermined distance from said axis.

17. The method of claim 16 wherein said shower is upwardly-moving.

18. The method of claim 16 wherein said second filler rod is formed by capturing particles in said shower of second blend of particles directly onto said tobacco-conveying surface in the width of said second shower.

19. The method of claim 16 wherein said second filler rod is formed by capturing particles in said second shower on a plurality of small vacuum wheels arranged across the width of said second shower so as to form a second plurality of substreams of said second blend of tobacco particles one on the outer surface of each of said small vacuum wheels, and laying said second substreams one on another on said second tobacco-conveying surface to provide said second filler rod.

20. The method of claim 16 wherein said trimming of said second filler rod is effected by a second trimmer located adjacent the periphery of circular side walls of said second vacuum wheels which coincides with the ends of the chords of a circle defining said second tobacco-conveying surface, so that each of said second bunches comprises a flat surface coinciding with the rectilinear chord of the circle subtended by the second tobacco-conveying surface and continuously-curved outer surface extending from the ends thereof to an apex at substantially the midpoint of the length chord.

21. The method of claim 15 wherein said tobacco particles in said second bunches of said second blend of tobacco are transferred to fill the space between each of the adjacent bunches of the first blend of tobacco particles by:

vertically aligning the second blend bunches with the spaces between the first blend bunches and the first blend bunches with the spaces between the second blend bunches, and subsequently converging said first-mentioned and said second tobacco-conveying surfaces so as to merge the second blend bunches with the spaces between the first blend bunches and the first blend bunches with the spaces between the second blend bunches, thereby to form said filler rod on said first-mentioned tobacco-conveying surface.

22. The method of claim 15 wherein said tobacco particles in said second bunches of said second blend of tobacco are transferred to fill the space between each of the adjacent bunches of the first blend of tobacco particles by:

vertically aligning the second blend bunches with the spaces between the first blend bunches and the first blend bunches with the spaces between the second blend bunches, removing the tobacco particles in the second blend bunches from said second tobacco-receiving surface, and transporting the removed tobacco particles into and to fill the spaces between the first blend bunches, thereby to form said filler rod on said first-mentioned tobacco-conveying surface.

23. The method of claim 22, wherein said first and second bunches are conveyed under the influence of vacuum into said vertical alignment and said tobacco particles in the second blend bunches are removed from the second conveying surface and transported into and to fill the spaces between the first blend bunches by releasing the vacuum on said second blend bunches and transferring the tobacco particles of said second blend bunches at least in part by drawing the same to said first-mentioned conveying surface employing the vacuum applied to the first-mentioned conveying surface.

24. The method of claim 23, wherein said first-mentioned conveyor surface transports said first bunches on the underside thereof during said filling step and said second conveyor surface transports said second bunches on the upper side thereof.

25. The method of claim 4 wherein said first blend bunches are further sculptured by cutting away a portion from each end thereof so that each end of the bunch is upright.

26. An apparatus for forming a tobacco filler rod, which comprises:

vacuum wheel means arranged for rotation about a horizontal axis and having a foraminous tobacco-conveying surface defined by a plurality of rectilinear chords of a circle having its centre coinciding with said axis and arranged about the periphery of said vacuum wheel between circular side walls, means for forming on said tobacco-conveying surface a plurality of bunches of a first blend of tobacco particles having a flat inner surface and a curved outer surface which curves upwardly from both its ends to a location of maximum thickness and defining a space between the first blend bunches extending from the tobacco-conveying surface outwardly to a thickness corresponding to said maximum thickness, and means for providing a second blend of tobacco particles filling the space between each of the adjacent bunches to the thickness corresponding to the maximum thickness of the bunches.

27. The apparatus of claim 26, wherein said means for forming said plurality of bunches of a first blend of tobacco particles on said tobacco-conveying surface comprises:

tobacco shower forming means for forming a vertically-flowing shower of tobacco particles of said first blend moving towards said vacuum wheel means and trimmer means located at the periphery of said vacuum wheel means for removing tobacco from said tobacco-conveying surface.

28. The apparatus of claim 27 wherein said shower forming means includes conveyor means for conveying a wide band of tobacco particles of said first blend to an upper end of a chute into which said wide band of first blend tobacco particles is delivered to form said shower downwardly moving in said chute and said vacuum wheel means is located adjacent a lower end of said chute substantially in the plane thereof to receive said first blend tobacco particles from said downwardly-moving shower on said tobacco-conveying surface as said vacuum wheel means rotates about its axis.

29. The apparatus of claim 28, wherein a plurality of vacuum wheels is arranged adjacent the periphery of said vacuum wheel means so as to intercept tobacco in said shower, form substreams of tobacco on the surface thereof, transport said substreams of tobacco to said tobacco-conveying surface and deposit said substreams on said tobacco-conveying surface.

30. The apparatus of claim 28 wherein means for removing tobacco from said tobacco-conveying surface is provided associated with said vacuum wheel means.

31. The apparatus of claim 30 wherein said tobacco removal means comprises a sculpting blade mounted adjacent the periphery of said vacuum wheel means upstream of said trimmer means to provide said bunches of said first blend of tobacco particles with upright ends.

32. The apparatus of claim 28 wherein said means for providing a second blend of tobacco particles filling the spaces between each of the adjacent bunches comprises:

second vacuum wheel means arranged for rotation about a horizontal axis and having a circular foraminous tobacco-conveying surface recessed between circular side walls, second tobacco shower forming means for forming a vertically-flowing shower of tobacco particles of said second blend moving towards said second vacuum wheel means, means for transporting said bunches of said first blend of tobacco particles from said first-mentioned vacuum wheel means to said second vacuum wheel means and to position the same on said circular foraminous tobacco-conveying surface to receive thereon tobacco from said shower of said second blend of tobacco particles, and second trimmer means located adjacent the periphery of said second vacuum wheel means for removing tobacco from said circular tobacco-conveying surface to provide a filler rod having alternating and overlapping bunches of first blend tobacco and second blend tobacco.

33. The apparatus of claim 32 wherein said second shower forming means includes second conveyor means for conveying a wide band of tobacco particles of said second blend to an upper end of a second chute into which said wide band of tobacco particles of said second blend falls to form said shower downwardly moving in said second chute and said second vacuum wheel means is located adjacent a lower end of said second chute substantially in the plane thereof to receive said second blend of tobacco particles from said shower on said circular tobacco-conveying surface and the first blend bunches thereon as said second vacuum wheel means rotates about its axis.

34. The apparatus of claim 33, wherein a second plurality of vacuum wheels is arranged adjacent the periphery of said second vacuum wheel means so as to intercept tobacco in said second chute, form substreams of tobacco on the surface thereof, transport said substreams of tobacco to said circular tobacco-conveying surface and deposit said substream on said circular tobacco-conveying surface and first blend bunches thereon.

35. The apparatus of claim 33 wherein said foraminous tobacco-conveying surface on said first-mentioned vacuum wheel means and said circular foraminous tobacco-conveying surface on said second vacuum wheel means are provided by a common endless foraminous belt arranged to pass around said first-mentioned vacuum wheel means to form the first blend bunches thereon, transport the bunches off the first-mentioned vacuum wheel and to the second vacuum wheel, pass around said second vacuum wheel means to receive second blend tobacco thereon and to form said filler rod, and transport the filler rod through further rod-processing operations and back to said first-mentioned vacuum wheel.

36. The apparatus of claim 35 wherein said transporting means include vacuum shroud means for maintaining vacuum on said tobacco bunches during said transportation and at least one guide means each comprising a plurality of radial arms extending from an axle and engaging said common belt in gaps between ends of said first blend bunches to enable said common belt to change direction.

37. The apparatus of claim 28 wherein said means for providing a second blend of tobacco particles filling the space between each of the adjacent bunches comprises:

second vacuum wheel means arranged for rotation about a second horizontal axis and having a second foraminous tobacco-conveying surface defined by a plurality of rectilinear chords of a circle having its centre coinciding with said second horizontal axis and arranged about the periphery of said second vacuum wheel between circular side walls, means for forming on said second foraminous tobacco-conveying surface a plurality of bunches of a second blend of tobacco particles having a flat inner surface and a curved outer surface which curves upwardly from both its ends to a location of maximum thickness and defines a space between the second blend bunches extending from said second tobacco-conveying surface outwardly to a thickness corresponding to said maximum thickness, means for positioning said first-mentioned and second foraminous tobacco-conveying surfaces to vertically align the second blend bunches with the spaces between the first blend bunches and the first blend bunches with the spaces between the second blend bunches, and means for removing the tobacco particles in the second blend bunches from said second foraminous tobacco-conveying surface and transport the same into and filling the spaces between the first blend bunches and form said filler rod on said first-mentioned foraminous tobacco-conveying surface.

38. The apparatus of claim 37 wherein said means for forming said plurality of second blend bunches on said second foraminous tobacco-conveying surface comprises:

second tobacco shower forming means for forming an upwardly-flowing shower of tobacco particles of said second blend moving towards said second vacuum wheel means and second trimmer means located at the periphery of said second vacuum wheel means for removing tobacco from said second foraminous tobacco-conveying surface, said second tobacco shower forming means including conveyor means for conveying a wide band of tobacco particles of said second blend to the lower end of a second chute into which said wide band of second blend tobacco particles is delivered to form said upwardly-flowing shower in said chute and said second vacuum wheel means is located adjacent to an upper end of said second chute substantially in the plane thereof to receive said second blend tobacco particles from said upwardly-moving shower on said second tobacco-conveying surface as said second vacuum wheel means rotates about its axis.

39. The apparatus of claim 38 wherein a first plurality of vacuum wheels is arranged adjacent the periphery of said first-mentioned vacuum wheel means so as to intercept first blend tobacco in said downwardly-moving shower, form substreams of first blend tobacco on the surface thereof, transport said substream of first blend tobacco to said foraminous tobacco-conveying surface of said first-mentioned vacuum wheel means and deposit said substreams on said tobacco-conveying surface to form a filler rod of said first blend tobacco particles for presentation to said first-mentioned trimming means, and a second plurality of vacuum wheels is arranged adjacent the periphery of said second vacuum wheel means so as to intercept second blend tobacco in said upwardly-moving shower, form substreams of second blend tobacco on the surface thereof, transport said substreams of second blend tobacco to said foraminous tobacco-conveying surface of said second vacuum wheel means and deposit said latter substreams on said second tobacco-conveying surface to form a filler rod of said second blend tobacco particles for presentation to said second trimming means.

40. The apparatus of claim 39 wherein said first-mentioned foraminous tobacco-conveying surface comprises a first foraminous endless belt arranged to pass around said first-mentioned vacuum wheel means to form the first-blend bunches thereon, transport the first blend bunches off the first-mentioned vacuum wheel means and in a generally horizontal or downwardly-sloping straight-line path with the first blend bunches on the underside thereof held by vacuum applied through first vacuum application means adjacent the upper side of said first foraminous belt for forming the filler rod thereon, and transport the filler rod through further rod-processing operations and back to said first-mentioned vacuum wheel, and said second foraminous tobacco-conveying surface comprises a second foraminous endless belt arranged to pass around said second vacuum wheel means to form the second-blend bunches thereon, transport the second-blend bunches off the second vacuum wheel means and in a straight-line path convergent with and in vertical alignment with said straight-line path of said first foraminous belt with the second blend bunches on the upper side thereof while vacuum is applied thereto through second vacuum application means adjacent the underside of said second foraminous belt, with the second blend bunches aligned with the spaces between the first blend bunches and the first blend bunches aligned with the spaces between the second blend bunches, and transport around a turn-round roller and back to said second vacuum wheel.

41. The apparatus of claim 40 wherein said second vacuum application means terminates at a downstream end whereby said second blend bunches are released from the application of vacuum thereto by said second vacuum application means and air flow defining means is provided downstream of said termination of said second vacuum application means to remove the tobacco particles in the second blend bunches from said second foraminous belt and transport the same onto and filling the spaces between the first blend bunches on the first foraminous belt under the influence of the vacuum applied by said first vacuum application means to form the filler rod.

* * * * *